US007641313B2

(12) United States Patent
LaBar

(10) Patent No.: US 7,641,313 B2
(45) Date of Patent: Jan. 5, 2010

(54) APPARATUS FOR FACILITATING INK TANK/PRINTHEAD REPLACEMENT IN AN IMAGING APPARATUS

(75) Inventor: Daniel Robert LaBar, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 440 days.

(21) Appl. No.: 11/734,284

(22) Filed: Apr. 12, 2007

(65) Prior Publication Data

US 2008/0252670 A1 Oct. 16, 2008

(51) Int. Cl.
*B41J 2/14* (2006.01)
*B41J 2/16* (2006.01)

(52) U.S. Cl. ..... 347/49; 347/84

(58) Field of Classification Search ..... 347/20, 347/49, 84–87

See application file for complete search history.

(56) References Cited

U.S. PATENT DOCUMENTS 6,481,829 B1 * 11/2002 Bailey et al. ..... 347/49

* cited by examiner

*Primary Examiner*—Juanita D Stephens
(74) *Attorney, Agent, or Firm*—Neill R. Kahle, Jr.

(57) ABSTRACT

An imaging apparatus configured for mounting a printhead, to which at least one ink tank is removably mounted, includes a print engine configured to move the printhead carrier along a bi-direction main scan path. The printhead carrier has a printhead latch having a printhead latch release button, which when actuated releases the printhead latch to allow removal of the printhead. The printhead has a respective ink tank latch for mounting the respective ink tank to a printhead body. The respective ink tank latch includes a respective ink tank release button which when actuated unlatches the respective ink tank latch to allow removal of the respective ink tank from the printhead body. An access panel has a first opening defining an ink tank removal location that permits access to the respective ink tank release button, while the access panel prevents access to the printhead latch release button.

20 Claims, 7 Drawing Sheets

APPARATUS FOR FACILITATING INK TANK/PRINTHEAD REPLACEMENT IN AN IMAGING APPARATUS

BACKGROUND OF THE INVENTION

1. Field of the Invention

The present invention relates to an imaging apparatus, and more particularly, to an ink tank/printhead replacement system for an imaging apparatus.

2. Description of the Related Art

An ink jet imaging apparatus, such as an ink jet printer, forms an image on a print medium, such as paper, by applying ink on the print medium. The ink jet printer includes a reciprocating printhead carrier. A semi-permanent printhead may be removably coupled to the reciprocating printhead carrier. The printhead has a body to which is attached an ink jet micro-fluid ejection device configured to eject one or more colors of ink. Each color of ink may be contained in a respective ink tank. Each ink tank is configured to facilitate fluid communication with the printhead, and each ink tank is configured to be removably coupled to the printhead.

In order to change the printhead, or individual ink tanks, the user opens some sort of access cover. When the user lifts the access cover, a sensor trips and alerts the firmware of the ink jet printer. The printhead carrier is then moved to the cartridge installation position. The user replaces the printhead, or individual ink tank(s), closes the access cover, and then the printhead carrier is returned, to its home position. Typically, ink tanks need to be replaced much more frequently than the semi-permanent printhead, and there may be four or more ink tanks coupled to the semi-permanent printhead that will need replacing, most likely at differing replacement intervals.

During tank replacement a user may inadvertently release and unseat the printhead from the printhead carrier. Repeated decoupling of the same semi-permanent printhead from the printhead carrier may be detrimental to print quality, and may result in premature printhead failure.

SUMMARY OF THE INVENTION

The present invention helps reduce user confusion between replacing one or more ink tanks versus replacing the semi-permanent printhead, which in turn reduces inadvertent decoupling of the semi-permanent printhead from the printhead carrier.

The terms "first" and "second" preceding an element name, e.g., first opening, second opening, etc., are used for identification, purposes to distinguish between elements having similar characteristics, and are not intended to necessarily imply order, nor are the terms "first" and "second" intended to preclude the inclusion of additional similar elements.

The invention, in one form thereof, is directed to an imaging apparatus configured for mounting a printhead, to which at least one ink tank is removably mounted. The imaging apparatus includes a controller, and a print engine having a printhead carrier and a printhead carrier drive mechanism. The controller is communicatively coupled to the printhead carrier drive mechanism. The printhead carrier drive mechanism is drivably coupled to the printhead carrier. The print engine is configured to move the printhead carrier along a bi-direction main scan path. The printhead carrier has a printhead latch having a printhead latch release button, which when actuated releases the printhead latch to allow removal of the printhead from the printhead carrier. The printhead has a printhead body configured to receive each respective ink tank, and has a respective ink tank latch for mounting the respective ink tank to the printhead body. The respective ink tank latch includes a respective ink tank release button which when actuated unlatches the respective ink tank latch to allow removal of the respective ink tank from the printhead body. An access panel has a first opening defining an ink tank removal location that permits access to the respective ink tank release button, while the access panel prevents access to the printhead latch release button.

The invention, in another form thereof, is directed to an imaging apparatus configured for mounting a printhead, to which a plurality of ink tanks is removably mounted. The imaging apparatus includes a print engine having a printhead carrier and a printhead carrier drive mechanism. The printhead carrier drive mechanism is drivably coupled to the printhead carrier. The print engine is configured to move the printhead carrier along a bi-direction main scan path. The printhead carrier has a printhead latch having a printhead latch release button, which when actuated releases the printhead latch to allow removal of the printhead from the printhead carrier. The printhead has a printhead body configured to receive each of the plurality of ink tanks, and has a respective ink tank latch for mounting each respective ink tank of the plurality of ink tanks to the printhead body. The respective ink tank latch includes a respective ink tank release button which when actuated unlatches the respective ink tank latch to allow removal of the respective ink tank from the printhead body. An access panel has a first opening defining an ink tank removal location where the respective ink tank release button is exposed and permits access to the respective ink tank release button while the access panel prevents access to the printhead latch release button. The access panel has a second opening defining a printhead removal location where the printhead latch, release button is exposed to permit access to the printhead latch release button. A controller is communicatively coupled to the printhead carrier drive mechanism. The controller executes program instructions for selectively moving the printhead carrier along the bi-direction main scan path to position the respective ink tank release button at the first opening to facilitate removal of the respective ink tank through the first opening; and for selectively moving the printhead carrier along the bi-direction main scan path to position the printhead latch release button at the second opening to facilitate removal of the printhead through the second opening.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate embodiments of the invention, and such exemplifications are not to be construed as limiting the scope of the invention in any manner.

DETAILED DESCRIPTION OF THE INVENTION

Figure 1:
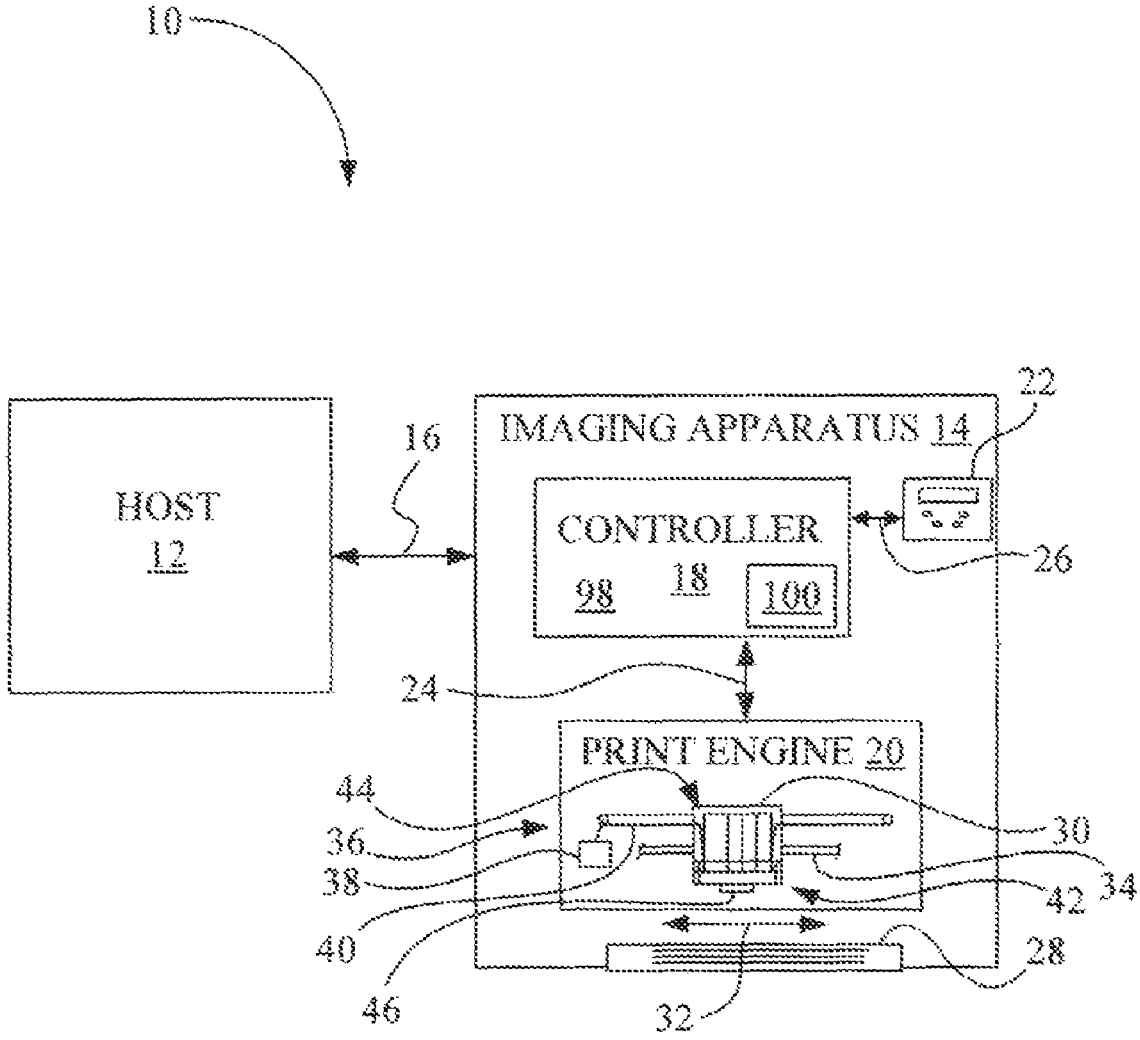
FIG. 1 is a diagrammatic depiction of an imaging system embodying the present invention.

FIG. 1 shows a diagrammatic depiction of an imaging system 10 embodying the present invention. Imaging system 10 may include a host 12 and an imaging apparatus 14. Imaging apparatus 14 communicates with host 12 via a communications link 16. Communications link 16 may be established by a direct cable connection, wireless connection or by a network connection such as for example an Ethernet local area network (LAN).

Alternatively, imaging apparatus 14 may be a standalone unit that is not communicatively linked to a host, such as host 12. For example, imaging apparatus 14 may take the form of an all-in-one, i.e., multifunction, machine that includes standalone copying and facsimile capabilities, in addition to optionally serving as a printer when attached to a host, such as host 12.

Host 12 may be, for example, a personal computer including an input/output (I/O) device, such as keyboard and display monitor. Host 12 further includes a processor, input/output (I/O) interfaces, memory, such as RAM, ROM, NVRAM, and a mass data storage device, such as a hard drive, CD-ROM and/or DVD units. During operation, host 12 may include in its memory a software program including program instructions that function as an imaging driver, e.g., printer driver software, for imaging apparatus 14. Alternatively, the imaging driver may be incorporated, in whole or in part, in imaging apparatus 14.

In the embodiment of FIG. 1, imaging apparatus 14 includes a controller 18, a print engine 20 and a user interface 22.

Controller 18 includes a processor unit and associated memory, and may be formed as an Application Specific Integrated Circuit (ASIC). Controller 18 communicates with print engine 20 via a communications link 24. Controller 18 communicates with user interface 22 via a communications link 26. Communications links 24 and 26 may be established, for example, by using standard electrical cabling or bus structures, or by wireless connection.

Print engine 20 may be, for example, an ink jet print engine configured for forming an image on a sheet of print media 28, such as a sheet of paper, transparency or fabric. Print engine 20 may include, for example, a reciprocating printhead carrier 30 that is guided along a bi-directional main scan path 32 by a laterally extending guide member, e.g., guide rod, 34. The motive force for driving printhead carrier 30 in a reciprocating manner along bi-directional scan path 32 is provided by a drive mechanism 36. Drive mechanism 36 includes, for example, a motor assembly 38 drivably coupled to printhead carrier 30 by a drive belt 40.

Figure 2:
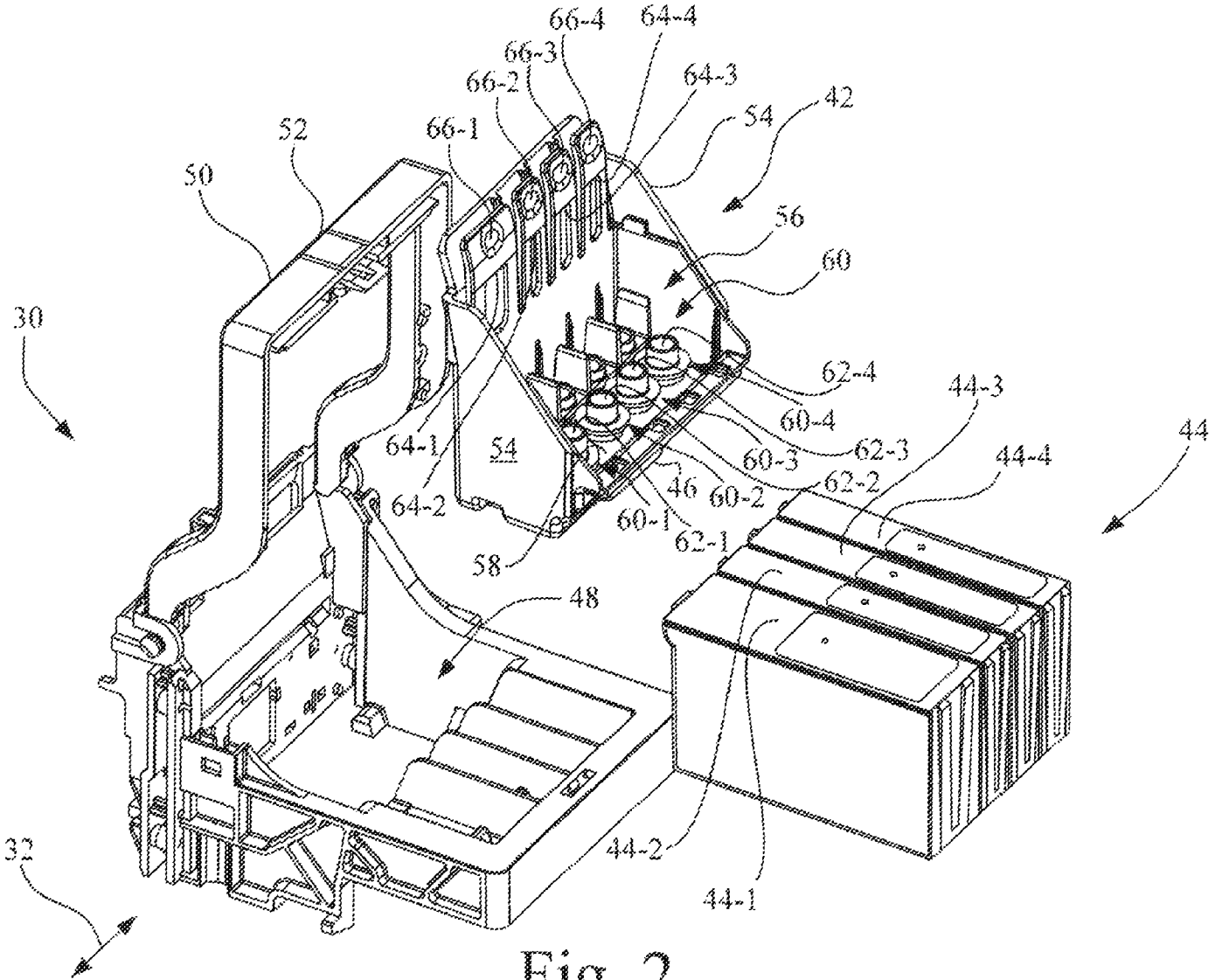
FIG. 2 is a perspective view of the printhead carrier of FIG. 1, with the printhead and ink tanks uninstalled.
Figure 3:
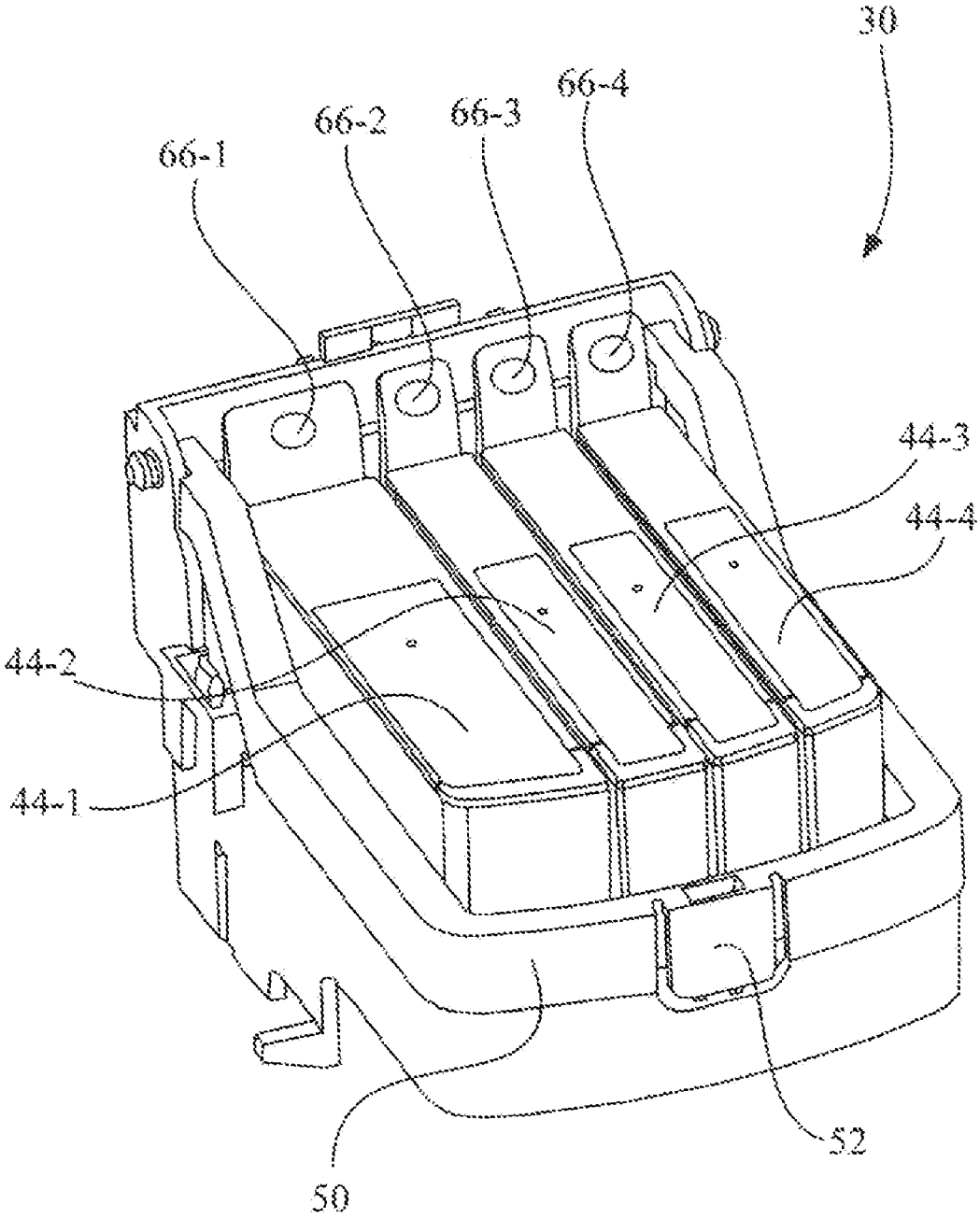
FIG. 3 is a perspective view of the printhead carrier of FIG. 1, with the printhead and ink tanks installed.

FIG. 2 shows in a perspective view printhead carrier 30, with a printhead 42 and a plurality of removable ink tanks 44 in an uninstalled state. FIG. 3 shows in a perspective view printhead carrier 30, with a printhead 42 and a plurality of removable ink tanks 44 in an installed state. While only one printhead 42 is shown in the present embodiment, it is contemplated that printhead carrier 30 may be configured to accommodate multiple printheads 42.

Referring to FIGS. 2 and 3, printhead carrier 30 is mechanically and electrically configured to mount and carry at least one printhead 42 to which is attached at least, one ink jet micro-fluid ejection device 46. Printhead 42 is mounted into position to printhead carrier 30 by inserting printhead 42 into a cavity 48 in printhead carrier 30, and is latched in position by a printhead latch 50. Printhead latch 50 includes a printhead latch release button 52, which when actuated, e.g., pressed, releases printhead latch 50 to allow removal of printhead 42 from printhead carrier 30. Printhead carrier 30 transports printhead 42, and in turn ink jet micro-fluid ejection device 46. In a reciprocating manner in a bi-directional main scan path 32 over an image surface of the sheet of prim media 28 during a printing operation.

Printhead 42 is configured to mount and carry the plurality of removable ink tanks 44, and to facilitate an ink transfer from one or more of the plurality of removable ink tanks 44 to micro-fluid ejection device 46. The plurality of removable ink tanks 44 may be made, for example, from plastic. The plurality of ink tanks 44 are individually identified as ink tanks 44-1, 44-2, 44-3 and 44-4, and may include a monochrome ink tank containing black ink, and three color ink tanks containing cyan, magenta, and yellow inks. Micro-fluid ejection device 46 may include an ink jet nozzle array for each color of ink.

In the present exemplary embodiment, printhead 42 includes printhead body 54 and a filter cap 56. Those skilled in the art will recognize that some printheads may not include a filter cap. Micro-fluid ejection device 46 is attached to a snout portion of printhead body 54. Filter cap 56 is attached to printhead body 54 via a hermetic seal, such as by welding or adhesive attachment. Filter cap 56 has a filter cap body 58 configured with a plurality of ink receiving devices 60, individually identified as ink receiving device 60-1, ink receiving device 60-2, ink receiving device 60-3, and ink receiving device 60-4. Each ink receiving device 60-1, 60-2, 60-3, and 60-4 includes a respective wick 62-1, 62-2, 62-3, and 62-4 that operably engages and facilitates fluid communication with the respective ink output ports of ink tanks 44-1, 44-2, 44-3 and 44-4, respectively. Each of wicks 62-1, 62-2, 62-3, and 62-4 may be constructed from a porous material, such as for example, from a porous felt material or a porous loam material. Ink tanks 44-1, 44-2, 44-3 and 44-4 are individually mounted to printhead 42 via a respective individual ink tank latch 64-1, 64-2, 64-3 and 64-4.

Each individual ink tank latch 64-1, 64-2, 64-3 and 64-4 includes a respective ink tank release button 66-1, 66-2, 66-3 and 66-4. Actuating, e.g., pressing, a respective ink tank release button of ink tank release buttons 66-1, 66-2, 66-3 and 66-4 unlatches, e.g., deflects, a respective ink tank latch 64-1, 64-2, 64-3 and 64-4, thereby releasing a respective ink tank 44-1, 44-2, 44-3, 44-4 to allow removal of the respective ink tank 44-1, 44-2, 44-3, 44-4 from printhead 42, and more particularly from printhead body 54.

Figure 4:
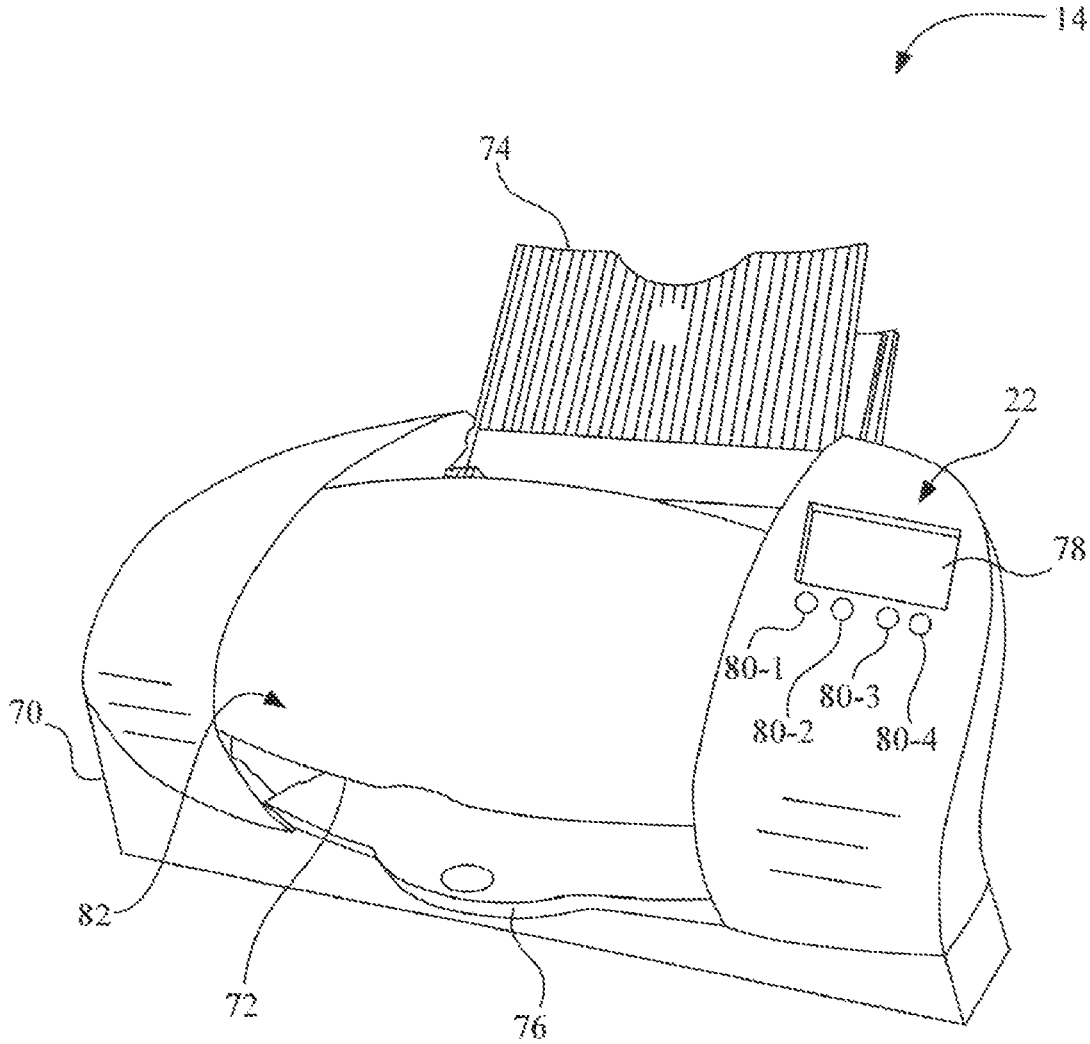
FIG. 4 is a perspective exterior view of an exemplary imaging apparatus of the imaging system of FIG. 1, with a cover in a closed position.

Referring now to FIG. 4, there is shown a perspective view of an exemplary exterior configuration for imaging apparatus 14 imaging apparatus 14 includes a housing 70, a cover 72, a media source tray 74 and a media exit tray 76. Cover 72, media source tray 74, and media exit tray 76 are each respectively mounted to housing 70. Also mounted to housing 70 is user interface 22 having a display screen 78 and control buttons 80-1, 80-2, 80-3, 80-4, etc. For example, control button 80-1 may be a power ON button, control button 80-2 may be a line feed button, etc.

Figure 5:
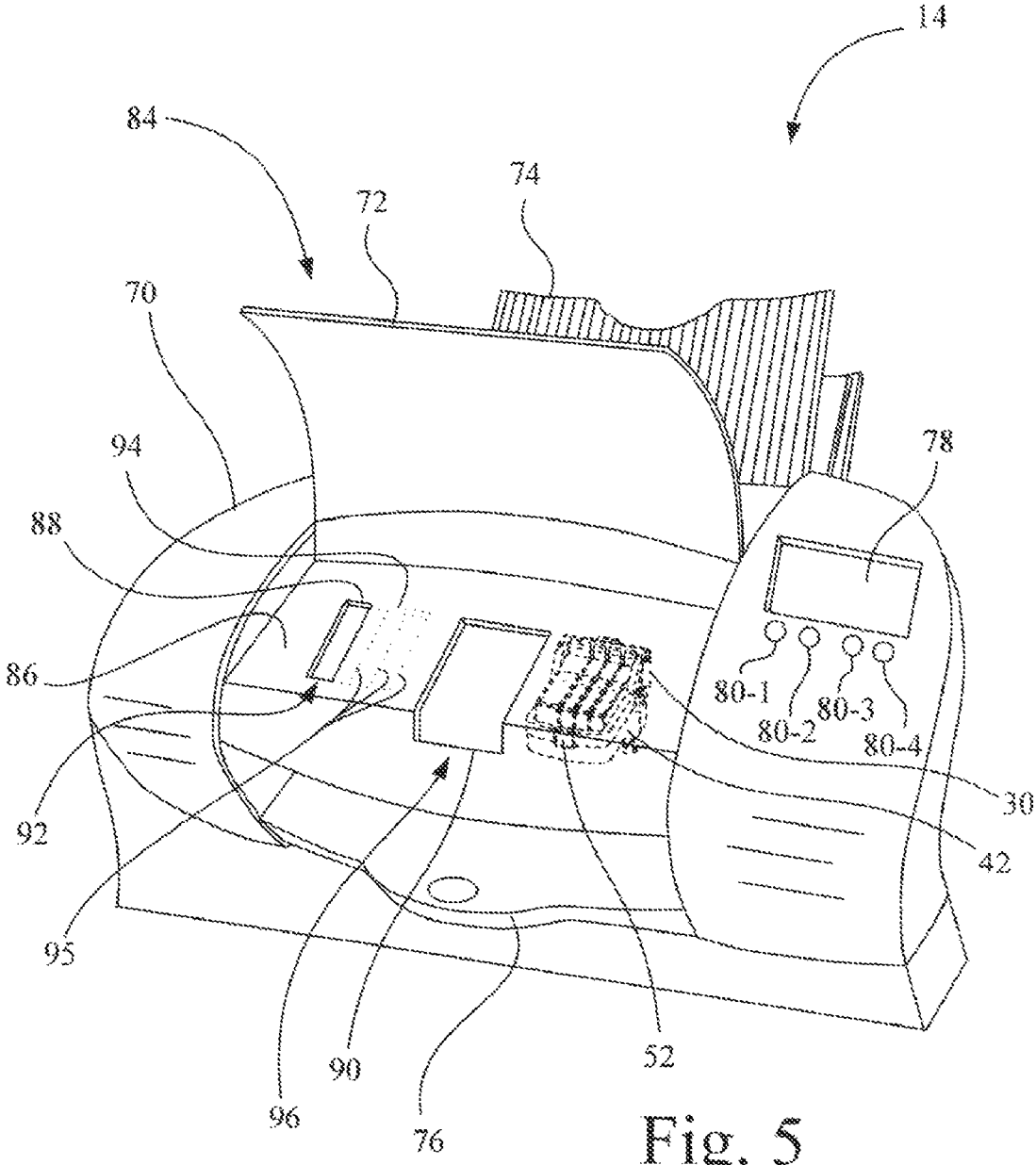
FIG. 5 is a perspective exterior view of the exemplary imaging apparatus of FIG. 4, with a cover in an open position.

As shown in FIGS. 4 and 5, cover 72 is movably attached to housing 70 to facilitate an opening and closing of cover 72 70, e.g., by a pivoting action. FIG. 4 shows cover 72 in a closed position 82, and FIG. 5 shows cover 72 in an open position 84. When cover 72 is in open position 84, there is exposed an access panel 86 having a first opening 88 and a second opening 90. While in the present embodiment cover 72 is shown as a single panel, it is contemplated that cover 72 may be formed by multiple panels.

First opening 88 defines an ink tank removal location 92 where one or more of ink tanks 44-1, 44-2, 44-3, or 44-4 may be removed and replaced. First opening 88 is sized and located to provide access to one or more of ink tank release button 66-1, ink tank release button 66-2, ink tank release button 66-3, and ink tank release button 66-4, without providing access to printhead latch release button 52. Also, first opening 88 is sized to facilitate removal of one or more of ink tanks 44-1, 44-2, 44-3, and/or 44-4, e.g., is sized to allow the respective ink tank to pass through first opening 88.

For example, first opening 88 represented by solid lines is sized to expose, and permit access to, only one of ink tank release buttons 66-1, 66-2, 66-3, 66- at a time while access panel 86 prevents access to printhead latch release button 52.

Alternatively, as illustrated by outer dotted lines 94, the size of first opening 88 may be designed to be larger, for example, so as to permit simultaneous access to any desired number of ink tank release buttons 66-1, 66-2, 66-3, 66-4, while access panel 86 covers over printhead latch release button 52 to prevent access to printhead latch release button 52 while one or more of ink tanks 44-1, 44-2, 44-3, or 44-4 is being changed.

Also, as illustrated by parallel dotted lines 95, first opening 88 may be formed of a plurality of individual apertures, with each aperture corresponding to a respective one of ink tanks 44, so that each Ink tank and corresponding ink tank release button has its own dedicated opening.

Second, opening 90 defines a printhead removal location 96. In the present embodiment, second opening 90 is shown as being spaced away from, first opening 88 to emphasize the separate functions of openings 88 and 90. However, alternatively, it is contemplated that first opening 88 and second opening 90 may overlap. Second opening 90 is sized and located to expose, and provide access to, printhead latch release button 52. Also, second opening 90 is sized and located to facilitate removal of printhead 42 from printhead carrier 30, e.g., is sized to allow printhead 42 to pass through second opening 90.

Figure 6:
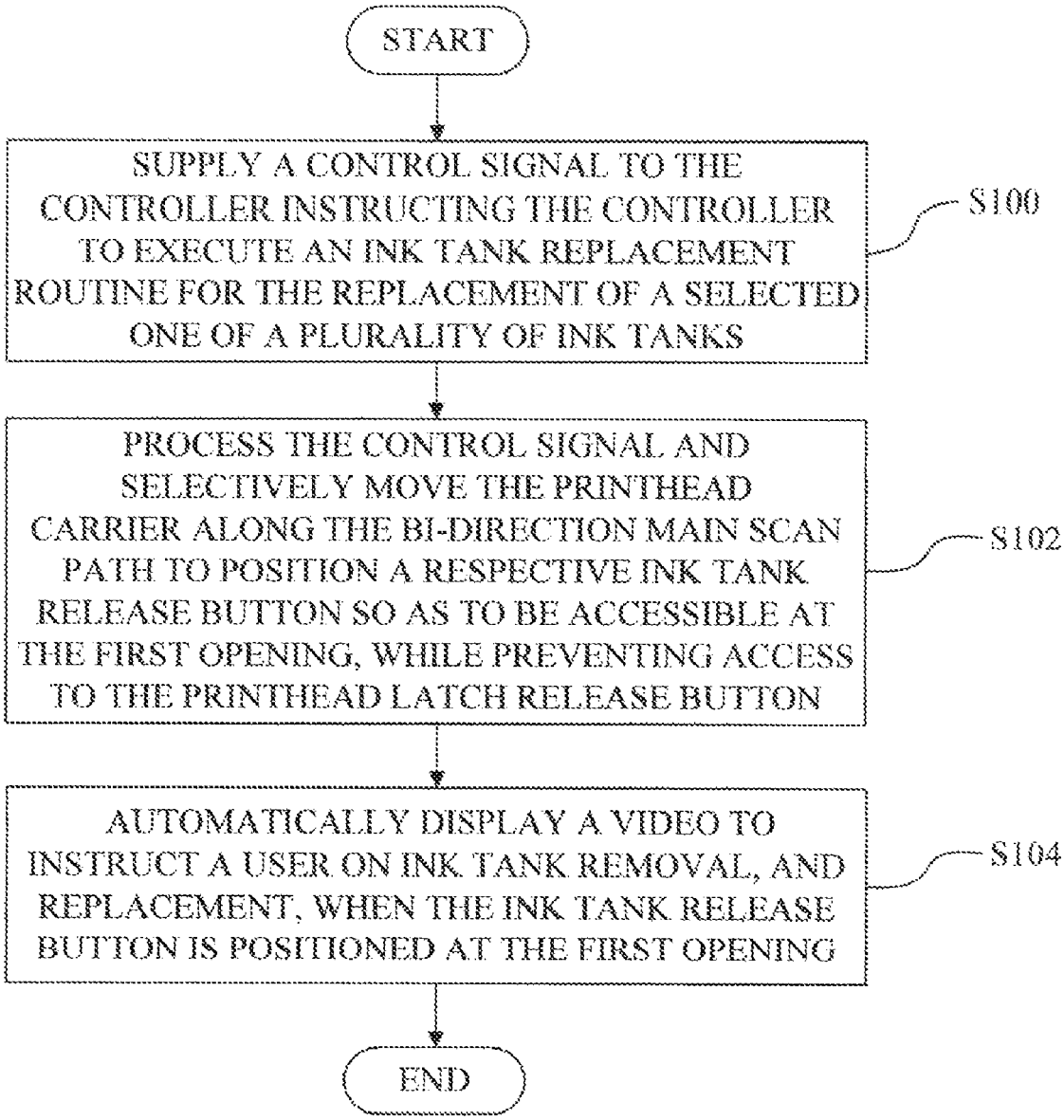
FIG. 6 is a flowchart of a method for facilitating removal and replacement of an ink tank, in accordance with an embodiment of the present invention.

FIG. 6 is a flowchart of a method for facilitating removal and replacement of an ink tank, in accordance with an embodiment of the present invention.

At act S100, a control signal is supplied to controller 18 instructing controller 18 to execute an ink tank replacement routine for the replacement of a selected one of the plurality of ink tanks 44. In the example that follows, it is presumed that the selected ink tank for removal and replacement is ink tank 44-2.

In one embodiment, for example, the signal source, for the control signal may be a ink tank usage monitor 98 (see FIG. 1) executing as program instructions on controller 18. For example, in one embodiment ink tank usage monitor 98 may include a sensor for sensing ink usage that sends ink usage data to controller 18. Once the ink usage reaches a threshold amount, then the ink tank usage monitor 98 generates the control signal to initiate the ink tank replacement routine for the depleted ink tank, e.g., ink tank 44-2. In another exemplary embodiment, ink tank usage monitor 98 may keep a count of the number of ink drops depleted from each of the plurality of ink tanks 44, and therefrom determine when an ink tank, such as ink tank 44-2, is to be replaced by comparing the count to a threshold number of depleted ink drops. Once the count reaches the threshold number, then the ink tank usage monitor 98 generates the control signal to initiate the ink tank replacement routine for the depleted ink tank, e.g., ink tank 44-2.

Alternatively, act S100 may be initiated manually by pushing a button, e.g., control button 80-3 on user interface 22, which, is communicatively coupled to controller 18. As a further alternative, act S100 may be initiated by a control signal provided by host 12.

At act S102, controller 18 executes program instructions to process the control signal and selectively move printhead carrier 30 along bi-direction main scan path 32 to position an ink tank release button, e.g., ink tank release button 66-2 of the plurality of ink tank release buttons, so as to be accessible at first opening 88 to facilitate a removal of the corresponding ink tank, e.g., ink tank 44-2, of the plurality of ink tanks 44, while preventing access to printhead latch release button 52. For example, movement of printhead carrier 30 is effected by program instructions executed by controller 18, which supplies position signals to drive mechanism 36, which in turn drives printhead carrier 30 to the desired position.

At act S104, when an ink tank release button, e.g., ink tank release button 66-2 corresponding to ink tank 44-2, is positioned at first opening 88, controller 18 executes program instructions to cause display screen 78 to automatically display a video to instruct a user on ink tank removal, and replacement. Act S104 may be optional.

Figure 7:
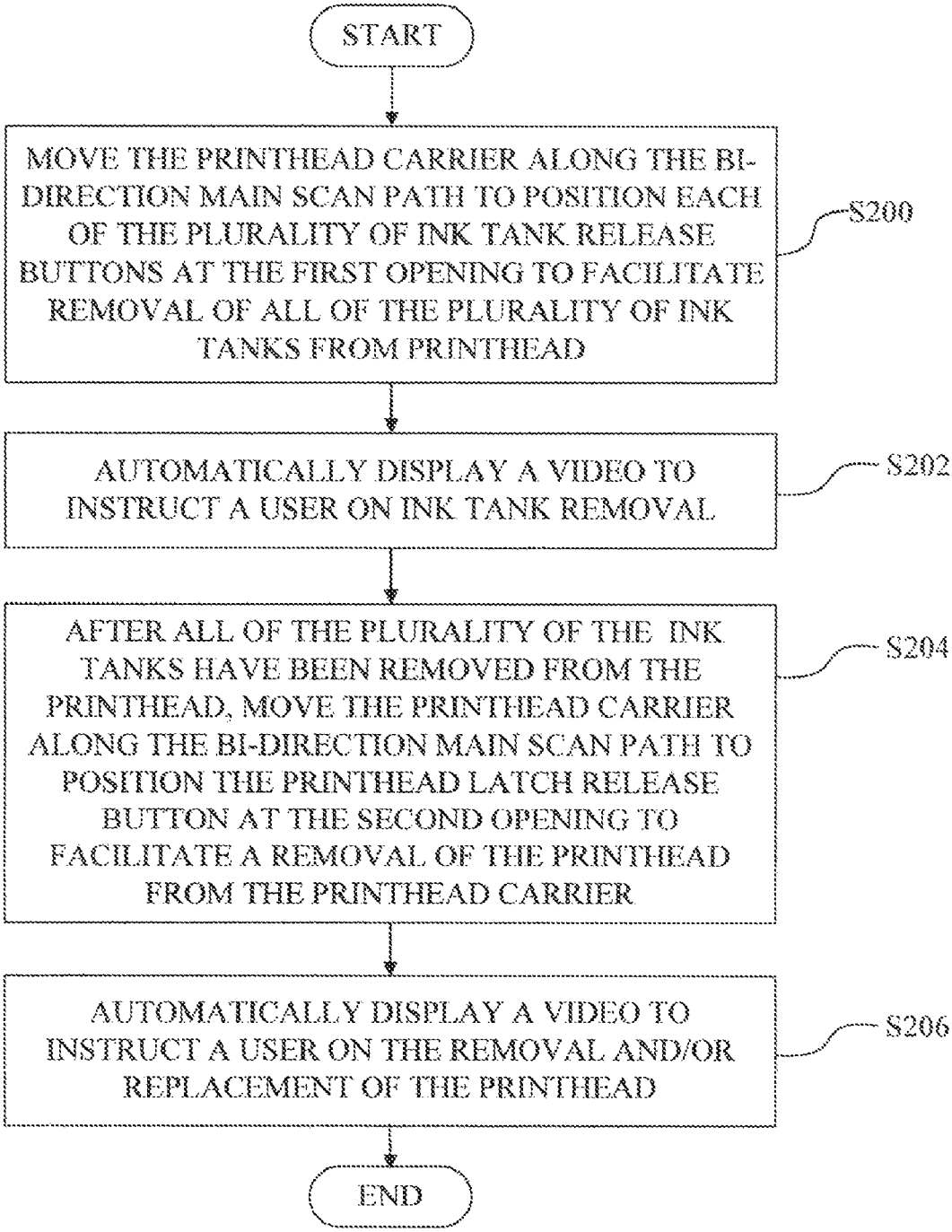
FIG. 7 is a flowchart of a method for facilitating removal and replacement of a printhead, in accordance with an embodiment of the present invention.

FIG. 7 is a flowchart of a method for facilitating removal and replacement of a printhead, in accordance with an embodiment of the present invention.

At act S200, printhead carrier 30 is moved along bi-direction main scan path 32 to position each of the plurality of ink tank release buttons 66-1, 66-2, 66-3, 66-4 at first opening 88 to facilitate removal of all of the plurality of ink tanks 44 from printhead 42. Depending on the configuration, e.g., size, of first opening 88 as discussed above, this positioning may be brought about by a series of sequential moves, or may be made in a single move. Movement of printhead carrier 30 is effected, for example, by program instructions executed by controller 18, which supplies position signals to drive mechanism 36, which in turn drives printhead carrier 30 to the desired position.

Act S200 may be initiated, for example, by a signal source supplying a control signal to controller 18 instructing controller 18 to execute a printhead replacement routine, in one embodiment, for example, the signal source may be a printhead usage monitor 100 (see FIG. 1) that is executing as program instructions on controller 18. For example, in one embodiment printhead usage monitor 100 may include a sensor for sensing ink usage that sends ink usage data to controller 18. Once the ink usage reaches a threshold amount, then printhead usage monitor 100 generates the control signal to initiate the printhead replacement routine for the printhead, e.g., printhead 42. In another exemplary embodiment, printhead usage monitor 100 may keep a count of the number of ink drops expelled from printhead 42, and therefrom determine when printhead 42 is to be replaced by comparing the count to a threshold number of expelled ink drops. Once the count reaches the threshold number, and cover 72 is in open position 84, then the printhead usage monitor 100 generates the control signal to initiate the printhead replacement routine.

Alternatively, act S200 may be initiated manually by pushing a button, e.g., control button 80-4 on user interface 22, which is communicatively coupled to controller 18. As a further alternative, act S200 may be initiated by a control signal provided by host 12.

At act S202, when an ink tank release button, e.g., ink tank release button 66-1, is positioned at first opening 88, controller 18 executes program instructions to cause display screen 78 to automatically display a video to instruct a user on ink tank removal. Act S202 may be optional. Acts S200 and S202 are repeated, if necessary, until all ink tanks 44 are removed from printhead 42. An indication that all of the plurality of ink tanks 44 have been removed from printhead 42 may be made, for example, by pressing a button on user interface 22, to initiate act S204.

At act S204, after all of the plurality of ink tanks 44 have been removed from printhead 42, then printhead carrier 30 is moved along bi-direction main scan path 32 to position printhead latch release button 52 at second opening 90 to facilitate a removal of printhead 42 from printhead carrier 30. Movement of printhead carrier 30 is effected by program instructions executed by controller 18, which supplies position signals to drive mechanism 36, which in turn drives printhead carrier 30 to the desired position.

At act S206, when printhead latch release button 52 is positioned at second opening 90, controller 18 executes program instructions to cause display screen 78 to automatically display a video to Instruct a user on the removal and/or replacement of printhead 44. Act S206 may be optional.

While this invention has been described with respect to embodiments of the invention, the present invention may be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An imaging apparatus configured for mounting a printhead, to which at least one ink tank is removably mounted, comprising:

a controller;

a print engine having a printhead carrier and a printhead carrier drive mechanism, said controller being communicatively coupled to said printhead carrier drive mechanism, said, printhead carrier drive mechanism being drivably coupled to said printhead carrier, said print engine being configured to move said printhead carrier along a bi-direction main scan path, said printhead carrier having a printhead latch having a printhead latch release button, which when actuated releases said printhead latch to allow removal of said printhead from said printhead carrier;

said printhead having a printhead body configured to receive each respective ink tank, of said at least one ink tank, and having a respective ink tank latch for mounting said respective ink tank to said printhead body, said respective ink tank latch including a respective ink tank release button which when actuated unlatches said respective ink tank latch to allow removal of said respective ink tank from said printhead body; and an access panel having a first opening defining an ink tank removal location that permits access to said respective ink tank release button, while said access panel prevents access to said printhead latch release button.

2. The imaging apparatus of claim 1, where said access panel has a second opening defining a printhead removal location where said printhead latch release button is exposed to permit access to said printhead latch release button.

3. The imaging apparatus of claim 1, wherein said first opening is sized and located to allow access to only one ink tank release button of a plurality of ink tank release buttons while said access panel prevents access to said printhead latch release button.

4. The imaging apparatus of claim 1, wherein said first opening is sized and located to allow access to at least one ink tank release button of a plurality of ink tank release buttons while said access panel prevents access to said printhead latch release button.

5. The imaging apparatus of claim 1, wherein said at least one ink tank includes a plurality of ink tanks and said printhead includes a plurality of ink tank release buttons individually corresponding to a respective ink tank of said plurality of ink tanks, further comprising:

a control signal source for supplying a control signal to said controller, and said controller executing program instructions to process said control signal and selectively move said printhead carrier along said bi-direction main scan path to position a first ink tank release button of said plurality of ink tank release buttons to be accessible at said first opening to facilitate a removal of a first ink tank of said plurality of ink tanks.

6. The imaging apparatus of claim 5, wherein said control signal source is an ink tank usage monitor that determines when said first ink tank is to be replaced.

7. The imaging apparatus of claim 5, wherein said control signal source is a button on a user interface communicatively coupled to said controller.

8. The imaging apparatus of claim 5, further comprising a user interface communicatively coupled to said controller, said user interface including a display screen, wherein when said first ink tank release button is positioned at said first opening, said display screen displays a video to instruct a user on ink tank removal.

9. The imaging apparatus of claim 1, further comprising:

a control signal source for supplying a control signal to said controller, and said controller executing program instructions to process said control signal and selectively move said printhead carrier along said bi-direction main scan path to position said printhead latch release button to be accessible at said second opening to facilitate a removal of said printhead from said printhead carrier.

10. The imaging apparatus of claim 9, further comprising a user interface communicatively coupled to said controller, said user interface including a display screen, wherein when said printhead latch release button is positioned at said second opening, said display screen displays a video to instruct a user on printhead removal.

11. The imaging apparatus of claim 1, wherein said at least one ink tank includes a plurality of ink tanks and said printhead includes a plurality of ink tank release buttons individually corresponding to each of said plurality of ink tanks, further comprising:

a signal source for supplying a control signal to said controller instructing said controller to execute a printhead replacement routine, said printhead replacement routine including:

moving said printhead carrier along said bi-direction main scan path to position each of said plurality of ink tank release buttons at said first opening to facilitate removal of all of said plurality of ink tanks from said printhead, and after all of said plurality of ink tanks have been removed from said printhead, then moving said printhead carrier along said bi-direction main scan, path to position said printhead latch release button at said second opening to facilitate a removal of said printhead from said printhead carrier.

12. The imaging apparatus of claim 11, wherein said signal source is a printhead usage monitor that determines when said printhead is to be replaced.

13. The imaging apparatus of claim 11, wherein said signal source is a button on a user interface communicatively coupled to said controller.

14. An imaging apparatus configured for mounting a printhead, to which a plurality of ink tanks is removably mounted, comprising:

a print engine having a printhead carrier and a printhead carrier drive mechanism, said printhead carrier drive mechanism being drivably coupled to said printhead carrier, said print engine being configured to move said printhead carrier along a bi-direction main scan path, said printhead carrier having a printhead latch having a printhead latch release button, which when actuated releases said printhead latch to allow removal of said printhead from said printhead carrier;

said printhead having a printhead body configured to receive each of said plurality of ink tanks, and having a respective ink tank latch for mounting each respective ink tank of said plurality of ink tanks to said printhead body, said respective ink tank latch including a respective ink tank release button which when actuated unlatches said respective ink tank latch to allow removal of said respective ink tank from said printhead body; and an access panel having a first opening defining an ink tank removal location where said respective ink tank release button is exposed and permits access to said respective ink tank release button while said access panel prevents access to said printhead latch release button, and a second, opening defining a printhead removal location where said printhead latch release button is exposed to permit access to said printhead latch release button; and a controller communicatively coupled to said printhead carrier drive mechanism, said controller executing program instructions for;

selectively moving said printhead carrier along said bi-direction main scan path to position said respective ink tank release button at said first opening to facilitate removal of said respective ink tank through said first opening; and selectively moving said printhead carrier along said bi-direction main scan path to position said printhead latch release button at said second opening to facilitate removal of said printhead through said second opening.

15. The imaging apparatus of claim 14, further comprising an ink tank usage monitor that determines when said respective ink tank is to be replaced, said ink tank usage monitor supplying a control signal to said controller to initiate movement of said printhead carrier along said bi-direction main scan path to said first opening.

16. The imaging apparatus of claim 14, further comprising a user interface having a control button, wherein when said control button is actuated said user interface supplies a control signal to said controller to initiate movement of said printhead carrier along said bi-direction main scan path to said first opening.

17. The imaging apparatus of claim 14, further comprising a printhead usage monitor that determines when said printhead is to be replaced, said printhead usage monitor supplying a control signal to said controller to initiate movement of said printhead carrier along said bi-direction main scan path to said second opening.

18. The imaging apparatus of claim 14, further comprising a user interface having a control button, wherein when said control button is actuated said user interface supplies a control signal to said controller to initiate movement of said printhead carrier along said bi-direction main scan path to said second opening.

19. The imaging apparatus of claim 14, further comprising a user interface communicatively coupled to said controller, said user interface including a display screen, wherein when said respective ink tank release button is positioned at said first opening, said display screen displays a video to instruct a user on ink tank removal.

20. The imaging apparatus of claim 14, further comprising a user interface communicatively coupled to said controller, said user interface including a display screen, wherein when said printhead latch release button is positioned at said second opening, said display screen displays a video to instruct a user on printhead removal.

* * * * *